United States Patent [19]

Pergola

[11] Patent Number: 4,593,926

[45] Date of Patent: Jun. 10, 1986

[54] SKI WHICH MAY BE DISASSEMBLED OR FOLDED

[76] Inventor: Nicola F. Pergola, 87 - 89th St., Brooklyn, N.Y. 11209

[21] Appl. No.: 639,728

[22] Filed: Aug. 13, 1984

[51] Int. Cl.[4] ..... A63C 5/02

[52] U.S. Cl. ..... 280/603; 403/43; 403/312

[58] Field of Search ..... 280/603, 602; 52/584, 52/726; 403/45, 43, 312

[56] References Cited

U.S. PATENT DOCUMENTS

| | | | |
|---|---|---|---|
| 2,289,459 | 7/1942 | Rydberg | 280/603 |
| 2,332,404 | 10/1943 | Smith | 280/603 |
| 2,387,061 | 10/1945 | Erickson | 280/603 |
| 2,894,760 | 7/1959 | Kolstad | 441/68 |
| 3,884,315 | 5/1975 | Fox | 280/603 |
| 4,248,449 | 2/1981 | Wilhelmy | 280/603 |
| 4,458,912 | 7/1984 | Bertonneau | 280/603 |

*Primary Examiner*—David M. Mitchell

*Assistant Examiner*—Joseph G. McCarthy

[57] ABSTRACT

A portable pair of skis may be packed in a small case for convenient storage and carrying. In one embodiment each ski is readily disassembled into two pieces, each ski piece having an end plate which mates with the end plate of the other ski piece. An assembled ski, which will function as originally designed and intended, comprises a bottom joining plate, which spans the two pieces, having four posts which are fixed to the bottom joining plate and which protrude through holes in the ski pieces and a top plate securing nuts, nut bearing plates and a removable over-center cam-action fastener which joins and applies tension to the two adjacent posts at the end plates. In another embodiment, the bottom plate is hinged and permanently fastened to the two ski pieces and two posts, which are fixed to the hinge, protrude through holes in the ski and the top plate. A removable over-center cam-action fastener is removably connected to the two posts via the grooved securing nuts.

16 Claims, 7 Drawing Figures

SKI WHICH MAY BE DISASSEMBLED OR FOLDED

BACKGROUND OF THE INVENTION

The present invention relates to skis and more particularly to portable skis which may be folded or disassembled.

The presently used downhill (Alpine) ski is relatively long; for example, a typical downhill ski may be 5 to 6½ feet in length.

It is inconvenient to travel with, or store, such long skis. Often they are too long to fit in the trunk of an automobile and they are awkward to carry onto a bus, subway or taxi. If one wishes to take one's skis to the office and leave on a ski trip after work, it is awkward to carry them to the office, store them during the day, and carry them on a trip.

These inconveniences have been recognized for many years, but a commercially acceptable portable ski, which folds or may be disassembled, is not yet available.

The ski is a highly engineered product. It must be relatively light in weight, so that it can be lifted and maneuvered on the snow without strain. Yet it must be strong and resilient to withstand constant shocks from turning, jumping and skiing over and between bumps.

Skiers are properly concerned with the "stiffness" of their skis, both in terms of axial torsion (twist about its imaginary axis) and longitudinal flexing (flexing perpendicular to its imaginary axis by pressure up or down at the ends of the ski).

It has proven very difficult to reconcile the competing objectives of a ski that will be foldable or disassembled, and yet which is desirable in its stiffness, resilience, weight and feel.

The advantages of a folding or disassembled ski have been known for many years and the patent literature shows many attempts to provide such a ski. For example, U.S. Pat. No. 3,689,093 entitled "Folding Ski" shows a ski having a mid-point hinge and end plates in which the ski is held together by a steel cable. In U.S. Pat. No. 3,884,315 entitled "Safety Ski" a ski has three hinged sections. The ski is a safety device, to prevent injury, and it does not fold for the convenience of folding and storage. U.S. Pat. No. 4,155,568 entitled "Sectional Ski" shows a ski which may be completely disassembled and has end plates having a coupling bar and notch. In U.S. Pat. No. 4,248,449 entitled "Cantilever Two Piece Ski" there is shown a cross-country ski which may be disassembled into two pieces. Each ski piece has a matching end plate and the ski pieces are joined by fasteners at their sides. U.S. Pat. No. 2,332,404 entitled "Hinged Ski" shows a two-piece ski which is hinged at its center and has studs and wing nuts to secure the ski in its assembled form. U.S. Pat. No. 3,439,928 entitled "Sectional Ski" shows a two-piece ski which is joined by male and female end connectors and a tightening screw. U.S. Pat. No. 3,730,544 entitled "Collapsible Ski Pole" shows ski poles which may be taken apart and reassembled.

OBJECTIVES AND FEATURES OF THE INVENTION

It is an objective of the present invention to provide a ski which may be folded or detached and conveniently stored and carried.

It is a further objective to provide such a ski which, after its assembly, may be skied upon with safety and assurance that it will not inadvertently become disassembled.

It is a further objective to provide such a ski which will provide the same type of spring action, flexibility and feel as a regular one-piece ski.

It is a further objective to provide such a ski which is readily assembled, and disassembled, by a relatively unskilled user without employing special tools or equipment.

It is a further objective of the present invention to provide a ski which may be assembled by the user from a plurality of pieces; for example, each ski is assembled from two pieces. When disassembled, the pair of skis is readily portable. The ski comprises first and second ski pieces each having a top surface, a bottom surface and an end plate. The two end pieces are adapted to be fitted together when the ski is assembled.

A bottom joining plate may be connected to the first and second ski pieces at their bottom surfaces and provides a flush and smooth surface. A first post protrudes from the top surface of the first ski piece and a second post protrudes from the top surface of the second ski piece. A fastener means, such as a cam-action tensioning device (toggle latch) is used to insure intimate mating of the assembled ski. It joins the first and second posts under tension via grooved securing nuts. To disassemble the ski pieces, the fastener means is first disjoined from the posts.

In one embodiment the bottom joining plate is a flat plate which is removably connected to the first and second ski pieces. The two ski pieces are completely separable. The first and second ski pieces have holes therethrough and the posts are fixed to said bottom joining plate and inserted through the holes.

The bottom joining plate may have two additional posts. In that case each ski-piece would have an additional hole, to receive one of the additional posts, and the additional posts may be secured by nuts bearing on a plate. Also preferably, the ski includes an additional joining plate which is removably connected on the top surface of the ski-pieces. The top joining plate spans the two pieces and has holes through which the posts protrude.

In an alternative embodiment the bottom joining plate is hinged. The hinge is located at the bottom juncture of the end plates. In the hinged embodiment preferably the ski further includes a joining plate which spans both ski-pieces and is connected at their top surfaces. It has holes through which the posts protrude. A cam-action tensioning device is used to insure intimate mating of the assembled ski. The "U" shaped arms of the tensioning device engage the circumferential grooves of the nuts which secure the two posts.

BRIEF DESCRIPTION OF THE DRAWINGS

Other objectives and features of the present invention will be apparent from the following detailed description, taken in conjunction with the accompanying drawings.

In the drawings.

DETAILED DESCRIPTION OF THE INVENTION

Figure 1:
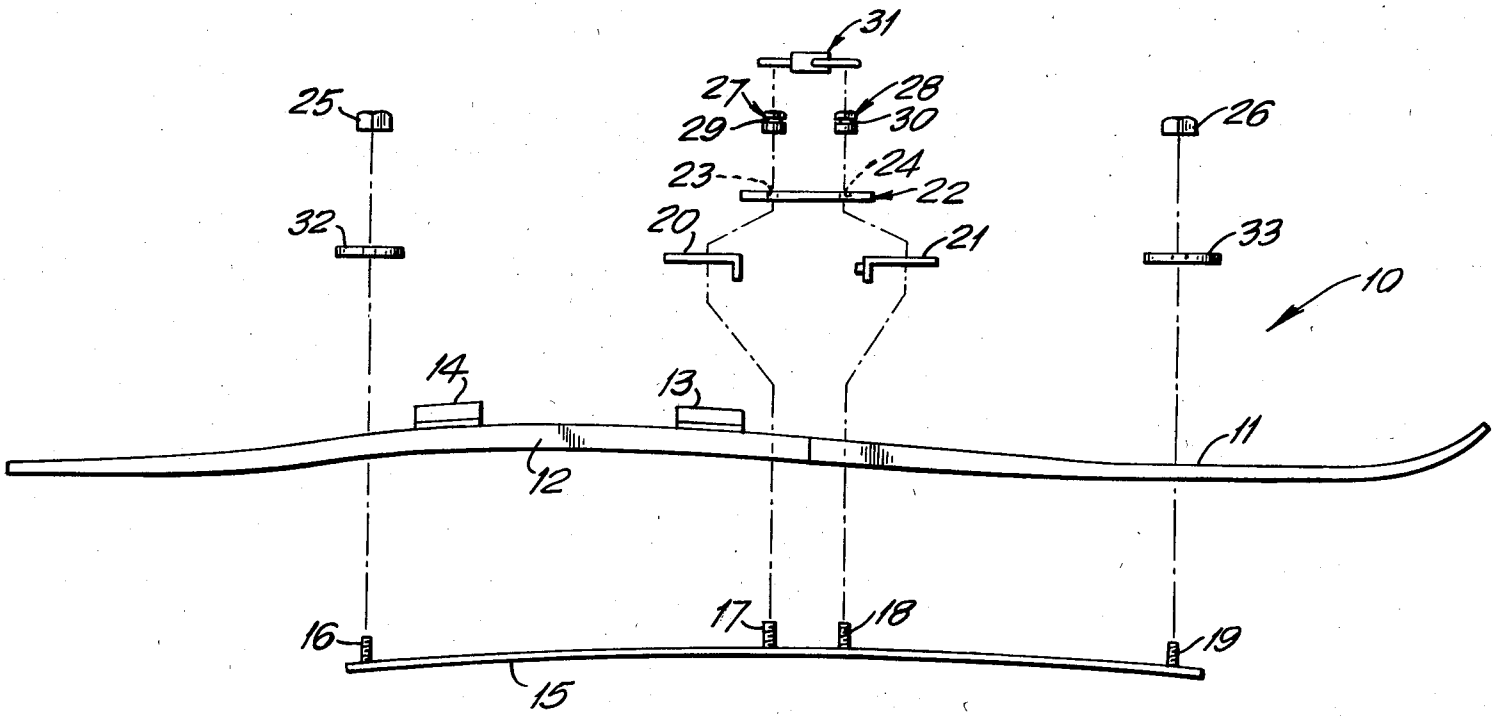
FIG. 1 is a side exploded view of the parts constituting the ski of the first embodiment of the present invention.

As shown in FIG. 1, the ski 10 of the first embodiment of the present invention includes front ski piece 11 and rear ski piece 12. The ski binding, consisting of a toe binding 13 and a heel binding 14, is mounted on the rear ski piece 12.

A flat elongated bottom joining plate 15, recessed in the ski, has protruding threaded posts (studs) 16–19, which preferably are steel posts welded to a stainless spring steel plate; for example, the posts 16–19 are ⅜-inch studs. The posts 16–19 fit within and through holes in the ski pieces 11,12. The plate 15 provides the main strength to resist torsion and especially longitudinal flexing.

Figure 2:
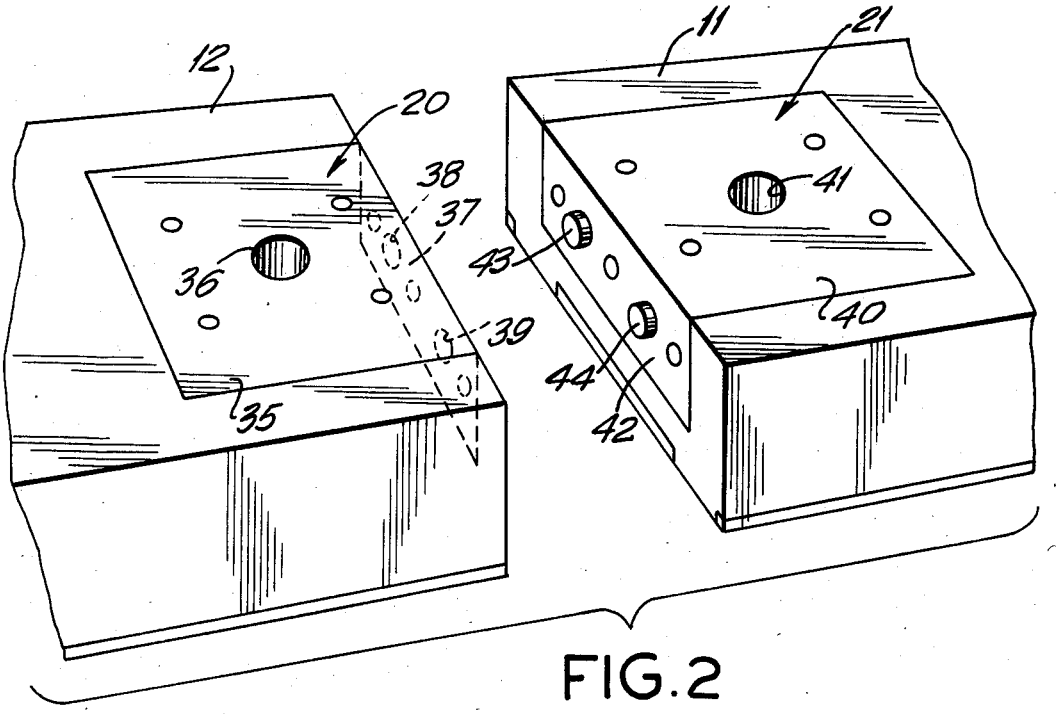
FIG. 2 is an enlarged perspective view of the end plates.
Figure 3:
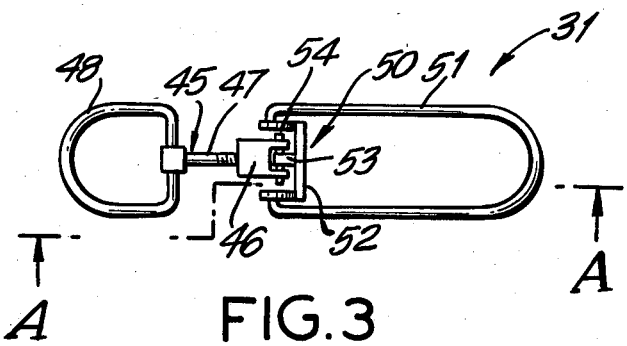
FIG. 3 is a top view of the fastener.
Figure 4:
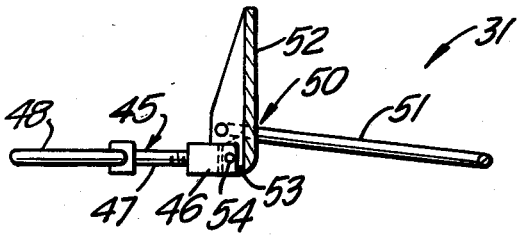
FIG. 4 is a side cross-sectional view taken along the line A—A of FIG. 3.

A first end plate 20 is fixed to the end of the rear ski piece 12 and a second end (edge) plate 21 is fixed to the end of the front ski piece 11, the end plates 20,21 being shown in detail in FIG. 2. The end plates 20,21 are fixed to the ski pieces 11, 12 using flat head screws especially at the mating edges. A top joining plate 22 (backing plate) has holes 23,24 through which posts 17, 18 protrude. In order to insure a ski that will function as a single flexible ski, the plain nuts 25,26 are screwed onto the posts 16,19 respectively and the grooves nuts 27, 28 have circumferential grooves 29,30 and the nuts 27,28 are screwed onto the posts 17,18. A tensioning fastener 31, shown in detail in FIGS. 3 and 4, is connected onto the nuts 27, 28 at the grooves. The fastener 31, when closed, exerts a tension force, pulling nuts 27,28 together, thereby insuring the male and female end plates mate intimately to provide torsional stability.

As shown in FIGS. 1 and 2, the first (female) end plate 20 has a horizontal portion 35 having a hole 36 through which the post 17 protrudes, and a vertical portion 37 having holes 38,39. The end plate 21 has a horizontal portion 40 having a hole 41 through which the post 18 protrudes and a vertical portion 42. Two bosses 43,44 are fixed on the vertical portion 42 and are adapted to snugly fit in the respective holes 38,39. The end plates are flush with the ski at the cut edge of the end surface.

Figure 7:
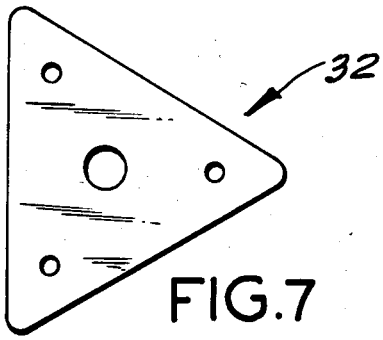
FIG. 7 is a top view of a bearing plate.

Preferably two nut-bearing plates 32,33, which are triangular as seen in top view in FIG. 7 and have a hole therethrough, are used beneath the nuts 25,26 and are mounted on the top surfaces of the ski pieces. (Only the nut-bearing plate 33 is shown.)

The fastener 31 is shown in FIGS. 3 and 4. Its fixed hasp portion 45 consists of a yoke 46, a screw threaded turnbuckle shaft 47 screwed into the yoke 46, and a U-shaped arm 48 attached to the turnbuckle shaft 47. Its movable hasp portion 50 consists of a U-shaped arm portion 51, a handle 52 having holes which rotatably mounts the arm portion 51, and a fulcrum portion 53 fixed to the handle 52 and which is pivotally mounted by the pin 54 on yoke 46. When the handle is lifted, as in FIGS. 3 and 4, the ends of the U-shaped arms are spread away from each other. When the handle is lowered, counterclockwise in FIG. 4, the ends of the U-shaped arms are brought closer together. This is an over-center cam-action type of fastener.

Figure 5:
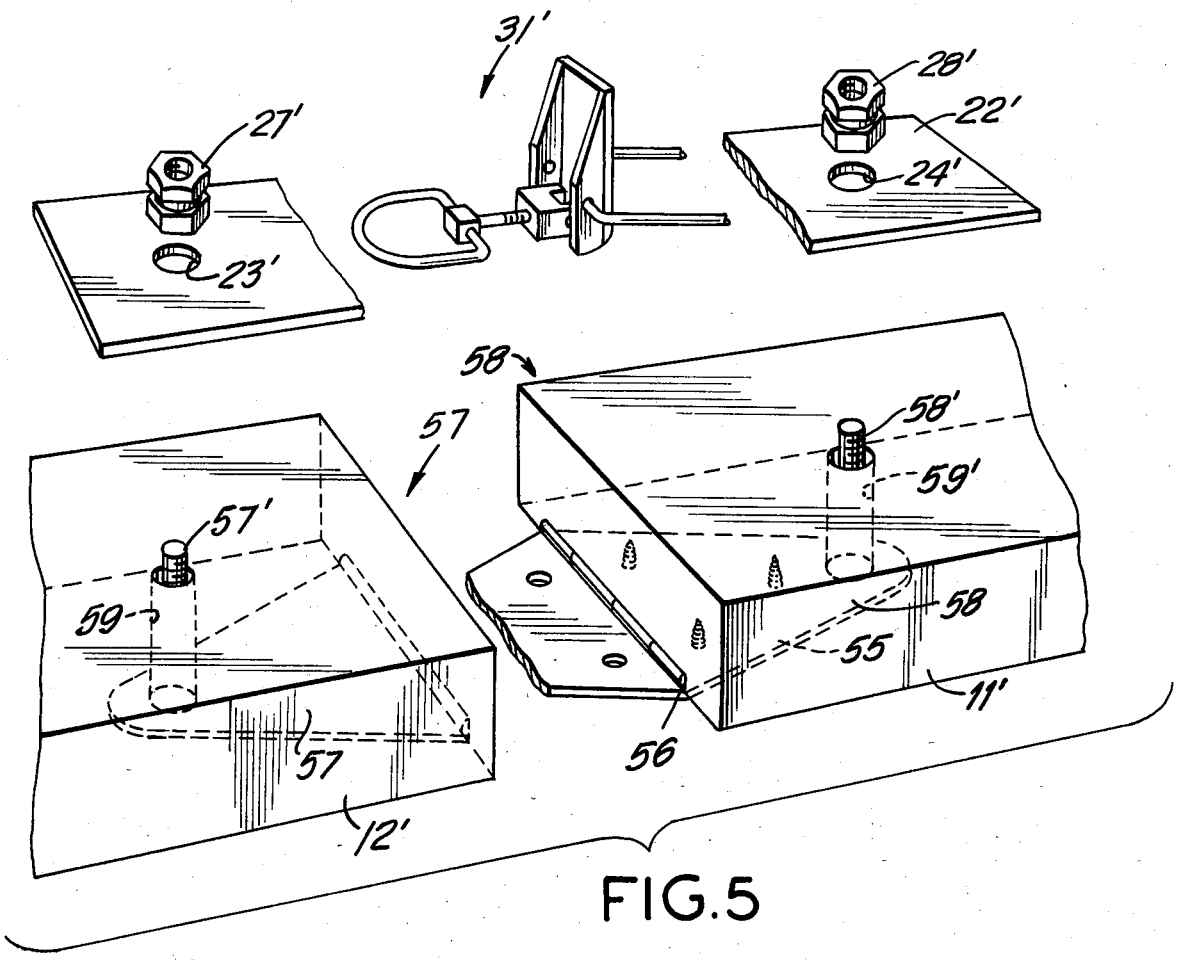
FIG. 5 is an alternative embodiment of the present invention shown in perspective view.

An alternative embodiment is shown in FIG. 5. It is a foldable ski. Instead of a one-piece bottom joining plate, as in FIG. 1, the bottom joining plate 55 is hinged by hasp-like piano-type hinge 56. The joining plate 55 has left and right sides 57, 58 which are recessed in and screwed onto the ski pieces 12′, 11′ respectively, using flat head screws. The threaded posts 57′, 58′ are fixed to the plate 55 and protrude upwards from holes 59′, 59′ in ski-pieces 11′, 12′, respectively. A top joining plate 22′ has holes 23′, 24′ to receive posts 57′, 58′. The grooves nuts 27′, 28′ are screwed onto the posts and fastener 31′, of the same type as fastener 31, is removably connected by looping its "U" arm ends in the grooves of nuts 27′, 28′.

In both embodiments, the bottoms of the ski pieces 11,12 and 11′,12′ are recessed to accurately receive the bottom joining plates. The bottoms of the ski, after the bottom support plates are in place, are flush and smooth. The bottom joining plate is seen recessed in FIG. 2.

The fastener 31, 31′ may be adjusted, using the turnbuckle shaft, to apply the desired tension to the grooved nuts. Such tension holds the ski pieces together and provides the proper and desired stifness against torsion (axial turning) and longitudinal flexing.

The present invention may be installed on new skis or may be retrofitted to existing skis. Preferably the various metal parts are of stainless steel or coated with a rust resistant coating such as a plastic coating, or cadmium plating.

Figure 6:
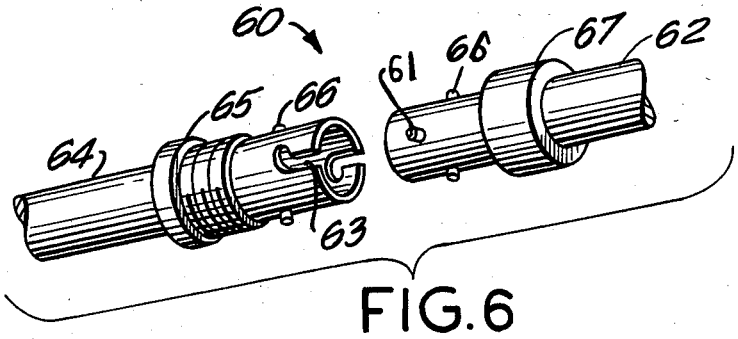
FIG. 6 is a perspective view of a portion of a ski-pole, for use in the present invention.

The ski-pole 60 of FIG. 6 may be used with the portable pair of skis of the present invention. The ski-pole is conventional in some respects and has a handle portion (grip) at one end and a basket at its opposite end. The shaft of the ski-pole 60 is separable into two pieces and may be reassembled, only the joindable ends of the two pieces of the ski-pole shaft being shown in FIG. 6. A bayonet joint consists of pin 61 fixed near the end of the shaft piece 62 and bayonet slot 63 near the end of the other shaft piece 64. A slidable sleeve 65 having external screw threads (male securing nut) engages a slidable sleeve 67 having internal screw threads (female securing nut). Both securing nuts slip over pins 66,66 to permit tightening the slidable sleeves. This two-piece ski-pole may be packed with the two-piece skis of the present invention in a carrying case, for example, a molded plastic case of about 15 inches high and 40 inches long which has molded inside portions to hold the ski-pieces and pole pieces.

What is claimed is:

1. A ski which may be assembled by the user from a plurality of pieces and which, when disassembled, is compact and readily portable, the ski comprising:

a first ski piece having a top surface, a bottom surface and a first end plate;

a second ski piece having a top surface, a bottom surface and a second end plate adapted to be fitted against said first end plate when the ski is assembled;

a joining plate connected to said first and second ski pieces at their bottom surfaces and providing therewith a flush and smooth surface;

a first post which protrudes from the top surface of said first ski piece and is fixed to the bottom joining plate, a second post which protrudes from the top surface of said second ski piece and is fixed to the same bottom joining plate;

a nut means which is removably screwed onto said posts to secure said joining plate to said ski; and tensioning means applied to said nut means to insure intimate mating of the first and second ski pieces under tension and which, to disassemble the ski pieces, is disjoined from the nut means.

2. A ski as in claim 1 wherein said nut means comprises two nuts each having a circumferential groove, which grooves receive said tensioning means.

3. A ski as in claim 1 wherein said joining plate is a flat plate which is removably connected to said first and second ski pieces so that the ski pieces are completely separable, wherein the first and second ski pieces each have holes therethrough from said bottom to said top surface, and wherein said posts fixed to said joining plate are inserted through said holes.

4. A ski as in claim 2 wherein said joining plate has two additional posts, each ski-piece has an additional hole to receive one of the additional posts and the ski includes nut means to removably secure said additional posts to their respective ski-pieces.

5. A ski as in claim 4 and further including an additional joining plate which is removably connected on the top surface of said ski-pieces to span the two pieces and which has holes through which the said posts protrude.

6. A ski as in claim 1 wherein said joining plate is hinged and said hinge is located at the bottom juncture of said end plates, so that the ski pieces may be folded.

7. A ski as in claim 6 and further including a joining plate which spans both ski-pieces connected at their top surfaces and having holes therein through which the posts protrude.

8. A ski as in claim 7 wherein each post comprises a bolt portion fixed to said hinged joining plate and a nut portion, having a circumferential groove, which nut portion is removably screwed onto said bolt portion to secure said joining plate to said ski.

9. A ski as in claim 1 wherein said tensioning means is a tensioned turnbuckle fastener.

10. A ski as in claim 1 wherein said tensioning means is an over-the-center cam-action fastener having an operating handle.

11. A ski as in claim 1 wherein said posts are secured by nuts each having a circumferential groove and the tensioning means has "U" shaped arms which fit in said grooves.

12. A ski which may be assembled by the user from a plurality of pieces and which, when disassembled, is compact and readily portable, the ski comprising:

a first ski piece having a top surface, a bottom surface and a first end plate and two holes therethrough from said bottom surface to said top surface;

a second ski piece having a top surface, a bottom surface and a second end plate adapted to be fitted against said first end plate when the ski is assembled, and two holes therethrough from said bottom surface to said top surface;

a first pair of posts which protrude from the top surface of said first ski piece and are adapted to be connected therewith, a second pair of posts which protrude from the top surface of said second ski piece and are adapted to be connected therewith the facing posts of each pair of posts being adjacent posts;

a joining plate connected to said first and second ski pieces at their bottom surfaces and providing therewith a flush and smooth surface; said joining plate being a flat plate which is removably connected to said first and second ski pieces so that the ski pieces are completely separable, wherein said four posts are fixed to said joining plate and are inserted through said holes;

tensioning means applied to said adjacent posts to insure intimate mating of the first and second ski pieces under tension and which, to disassemble the ski pieces, is disjoined from the adjacent posts; and nuts screwed onto said posts to fasten said joining plate to said ski pieces.

13. A ski as in claim 12 and further including an additional joining plate which is removably connected on the top surface of said ski-pieces to span the two pieces and which has holes through which the two adjacent posts protrude.

14. A ski as in claim 12 wherein said fastener means is a tensioned turnbuckle fastener.

15. A ski as in claim 12 wherein said fastener means is an over-the-center cam-action fastener having an operating handle.

16. A ski as in claim 12 wherein said adjacent posts are secured by nuts each having a circumferential groove and the fastener means has "U" shaped arms which fit in said grooves.

* * * * *